US009760045B2

(12) United States Patent
Hayashi et al.

(10) Patent No.: US 9,760,045 B2
(45) Date of Patent: Sep. 12, 2017

(54) IMAGE FORMING APPARATUS AND IMAGE FORMING METHOD

(71) Applicant: Konica Minolta, Inc., Chiyoda-ku, Tokyo (JP)

(72) Inventors: Kohei Hayashi, Okazaki (JP); Yusuke Mamiya, Nagoya (JP); Masashi Saito, Hachioji (JP); Yutaka Otsuka, Toyokawa (JP); Ryohei Matsuo, Toyokawa (JP); Toshihito Kobayashi, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/177,811

(22) Filed: Jun. 9, 2016

(65) Prior Publication Data

US 2016/0370741 A1 Dec. 22, 2016

(30) Foreign Application Priority Data

Jun. 19, 2015 (JP) ..... 2015-123960

(51) Int. Cl.
*G03G 15/20* (2006.01)

(52) U.S. Cl.
CPC ..... *G03G 15/2039* (2013.01); *G03G 15/2064* (2013.01)

(58) Field of Classification Search
CPC ..... G03G 15/2039; G03G 15/205
See application file for complete search history.

(56) References Cited

U.S. PATENT DOCUMENTS

2011/0064440 A1* 3/2011 Saitoh ..... G03G 15/2042 399/69
2011/0217059 A1* 9/2011 Kato ..... G03G 15/00 399/43

FOREIGN PATENT DOCUMENTS

JP 11054242 A 2/1999
JP 2009025464 A * 2/2009

OTHER PUBLICATIONS

Machine translation of JP 2009-025464 A obtained on Jan. 23, 2017.*

* cited by examiner

*Primary Examiner* — Gregory H Curran
(74) *Attorney, Agent, or Firm* — Cantor Colburn LLP

(57) ABSTRACT

An image formation apparatus includes: a fixer that fixes a toner image onto a sheet by heat and pressure, and includes: a heat source; a first rotary member that is heated by the heat source; a temperature sensing unit that senses a temperature of the first rotary member; and a second rotary member that forms a nip with the first rotary member for applying heat and pressure to the sheet; and a controller that calculates a nip width of the nip in a passing direction of the sheet with use of a rotation period and a rest period of the first rotary member during which the heat source operates, and changes a target temperature of the first rotary member in accordance with the calculated nip width.

20 Claims, 14 Drawing Sheets

FIG. 7

| Nip width d (mm) | Less than 5.3 | 5.3 or more to less than 5.5 | 5.5 or more |
|---|---|---|---|
| Decrease amount of target temperature (℃) | 0 | 5 | 10 |

FIG. 8

| Section | Corrected rotation period $\delta_{rot}$ (sec) |
|---|---|
| 1 | Less than 50 |
| 2 | 50 or more to less than 100 |
| 3 | 100 or more to less than 150 |
| 4 | 150 or more to less than 200 |
| 5 | 200 or more to less than 250 |
| 6 | 250 or more to less than 300 |

| Section | Corrected rotation period $\delta_{rot}$ (sec) |
|---|---|
| 7 | 300 or more to less than 350 |
| 8 | 350 or more to less than 400 |
| 9 | 400 or more to less than 450 |
| 10 | 450 or more to less than 500 |
| 11 | 500 or more to less than 550 |
| 12 | 550 or more to less than 600 |

| Section | Corrected rotation period $\delta_{rot}$ (sec) |
|---|---|
| 13 | 600 or more to less than 650 |
| 14 | 650 or more to less than 700 |
| 15 | 700 or more to less than 750 |
| 16 | 750 or more to less than 800 |
| 17 | 800 or more to less than 850 |
| 18 | 850 or more |

FIG. 13

| | Internal temperature (℃) | | |
|---|---|---|---|
| | Ordinary temperature | Low temperature | High temperature |
| Plain paper | 160 | 165 | 155 |
| Heavy paper 1 | 165 | 170 | 160 |
| Heavy paper 2 | 170 | 175 | 165 |
| Thin paper | 155 | 160 | 150 |

FIG. 14

| | Nip width d (mm) | | |
|---|---|---|---|
| | Less than 5.3 | 5.3 or more to less than 5.5 | 5.5 or more |
| Plain paper | 0℃ | 5℃ | 10℃ |
| Heavy paper 1 | 0℃ | 2℃ | 5℃ |
| Heavy paper 2 | 0℃ | 3℃ | 7℃ |
| Thin paper | 3℃ | 6℃ | 8℃ |

IMAGE FORMING APPARATUS AND IMAGE FORMING METHOD

CROSS-REFERENCE TO RELATED APPLICATIONS

The present invention claims priority under 35 U.S.C. §119 to Japanese Application No. 2015-123960, filed Jun. 19, 2015, the entire content of which is incorporated herein by reference.

BACKGROUND OF THE INVENTION (1) Field of the Invention

The present invention relates to an image forming apparatus and an image forming method, and particularly to an image forming apparatus including a fixer that fixes a toner image onto a sheet by heat and pressure.

(2) Related Art

The image forming apparatus disclosed in Japanese Patent Application Publication No. H11-54242 has been known as an image forming apparatus including a fixer that fixes a toner image onto a sheet by heat and pressure. In general, the fixer included in this type of image forming apparatus forms a nip by bringing a fixing roller and a pressure roller into pressure-contact with each other, causes a sheet to pass through the nip while heating the fixing roller by a heater or the like, and thus to fix a toner image onto the sheet. At this time, a nip width that is a width of the nip in a conveyance direction of the sheet varies due to thermal expansion of the pressure roller, and so on. Also, failure of appropriate control of the nip width to be a predetermined value might cause a problem such as crinkles, curls, and the like on the sheet. Accordingly, in order to appropriately control the nip width, the fixer included in the image forming apparatus such as described above includes a temperature adjuster such as an air blower and a heater, an automatic pressure-contact and release mechanism that changes the pressure-contact status between the fixing roller and the pressure roller in accordance with the operation status of the fixer, or the like.

SUMMARY OF THE INVENTION

By the way, there has been recently proposed to omit the temperature adjuster, the automatic pressure-contact and release mechanism, or the like for size reduction of image forming apparatuses, cost reduction, and so on. However, as described above, it is difficult to appropriately control the nip width without using the temperature adjuster, the automatic pressure-contact and release mechanism, or the like.

The present invention aims to provide an image forming apparatus capable of appropriately controlling the nip width without a temperature adjuster, an automatic pressure-contact and release mechanism, or the like, and an image forming method for use in the image forming apparatus.

One aspect of the present invention provides an image formation apparatus comprising: a fixer that fixes a toner image onto a sheet by heat and pressure, and includes: a heat source; a first rotary member that is heated by the heat source; a temperature sensing unit that senses a temperature of the first rotary member; and a second rotary member that forms a nip with the first rotary member for applying heat and pressure to the sheet; and a controller that calculates a nip width of the nip in a passing direction of the sheet with use of a rotation period and a rest period of the first rotary member during which the heat source operates, and changes a target temperature of the first rotary member in accordance with the calculated nip width.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings:

FIG. 7 is a table showing a relation between the nip width and a decrease amount of a target temperature;

FIG. 8 is a table exemplifying sections of a corrected rotation period;

FIG. 13 is a table exemplifying the target temperature for each combination of an internal temperature of the image forming apparatus and sheet type; and FIG. 14 is a table exemplifying the decrease amount of the target temperature for each combination of the nip width and the sheet type.

DESCRIPTION OF PREFERRED EMBODIMENTS

Figure 1:
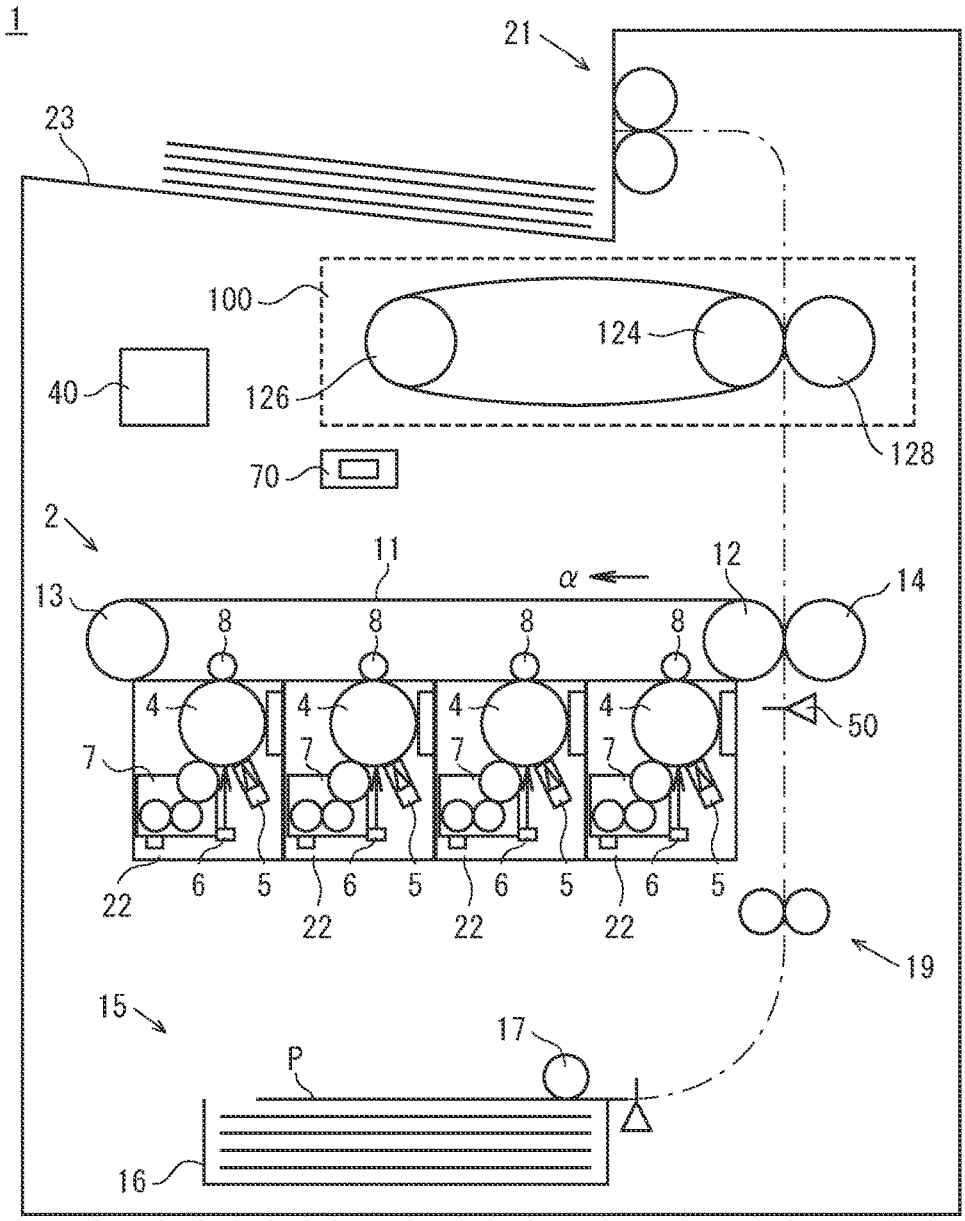
FIG. 1 shows the whole configuration of an image forming apparatus relating to an embodiment of the present invention.

The following explains an image forming apparatus and an image forming method relating to an embodiment of the present invention, with reference to the drawings attached hereto. The same members and parts in the drawings have the same numeral references, and duplicate explanation is omitted.

(Schematic Configuration of Image Forming Apparatus, see FIG. 1)

An image forming apparatus 1 is a so-called tandem type color printer employing an electronic photography system, and performs printing on sheets by synthesizing respective toner images of four colors (Y: yellow, M: magenta, C: cyan, and K: black). The image forming apparatus 1 has a function of forming images on sheets P based on image data scanned by a scanner. As shown in FIG. 1, the image forming apparatus 1 includes an image forming unit 2, a paper feed unit 15, a timing roller pair 19, a fixer 100, a conveyance sensor 50, a paper ejection roller pair 21, a paper ejection tray 23, an internal temperature sensor 70, and a controller 40.

The controller 40 controls the entire image forming apparatus 1, and is composed for example of electric circuits including a CPU. Also, the controller 40 acquires information of the temperature inside the image forming apparatus 1 from the internal temperature sensor 70 included in the image forming apparatus 1, and uses the information for controlling the components.

The paper feed unit 15 supplies the sheets P piece by piece, and includes a paper tray 16 and a paper feed roller 17. The sheets P before printing are stacked on the paper tray 16. The paper feed roller 17 feeds the sheets P, which are stacked on the paper tray 16, piece by piece.

The timing roller pair 19 adjusts a timing to convey the sheet P, which has been conveyed by the paper feed roller 17, such that toner images are secondarily transferred onto the sheet P by the image forming unit 2.

The image forming unit 2 forms toner images on the sheet P, which has been supplied by the paper feed unit 15. Also, the image forming unit 2 includes four image creating units 22 and four transfer units 8 which correspond one-to-one to the Y, M, C, and K colors, an intermediate transfer belt 11, a driving roller 12, a driven roller 13, and a secondary transfer roller 14.

The image creating units 22 each include a photosensitive drum 4, a charger 5, an optical scanner 6, and a developing unit 7.

The photosensitive drums 4 are each cylindrical, and rotate in the clockwise direction in FIG. 1. The chargers 5 each charge the circumferential surface of a corresponding photosensitive drum 4. The optical scanners 6 each perform beam scanning on the circumferential surface of the photosensitive drum 4. As a result, an electrostatic latent image is formed on the circumferential surface of the photosensitive drum 4.

The developing units 7 each develop the electrostatic latent image on the photosensitive drum 4 to form a toner image.

The intermediate transfer belt 11 is suspended with tension between the driving roller 12 and the driven roller 13. The transfer units 8 are each disposed so as to face the inner circumferential surface of the intermediate transfer belt 11, and each primarily transfer the toner image, which has been formed on the photosensitive drum 4, onto the intermediate transfer belt 11. The driving roller 12 drives the intermediate transfer belt 11 in a direction indicated by an arrow a in FIG. 1. This enables the intermediate transfer belt 11 to convey the toner image to the secondary transfer roller 14.

The secondary transfer roller 14 faces the intermediate transfer belt 11, and has a drum shape. Through application of a transfer voltage, the secondary transfer roller 14 secondarily transfers the toner image, which is carried by the intermediate transfer belt 11, onto the sheet P passing through between the secondary transfer roller 14 and the intermediate transfer belt 11.

The sheet P, onto which the toner image has been secondarily transferred, undergoes fixing processing performed by the fixer 100, which is described later, and then is ejected to the paper ejection tray 23 by the paper ejection roller pair 21. Note that the conveyance sensor 50 is provided on the upstream side relative to the fixer 100 in a sheet conveyance direction, and senses passing of the sheets P which are conveyed to the fixer 100.

Figure 2:
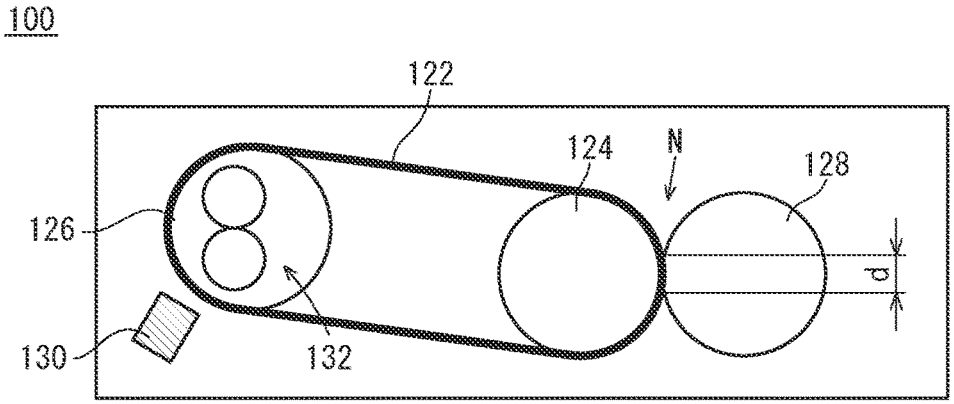
FIG. 2 shows the configuration of a fixer relating to the embodiment of the present invention.

(Configuration of Fixer, see FIG. 2)

The fixer 100 is a device that fixes a toner image onto a sheet P by heat and pressure. Also, the fixer 100 includes a fixing belt 122, a fixing roller 124, a heating roller 126, a pressure roller 128, a temperature sensor 130, and a halogen heater 132.

The fixing belt 122 is an endless elastic member that is suspended with tension between the fixing roller 124 as a driving roller and the heating roller 126 as a driven roller. Specifically, the fixing belt 122 for example includes a base surface layer made of polyimide (PI), and an elastic layer made of silicone rubber or the like and a surface release layer made of fluorine resin such as perfluoroalkoxy (PFA) resin that are sequentially layered on the base surface layer. Note that the surface release layer made of fluorine resin is provided in order to prevent deposition of toner on the surface of the fixing belt 122.

The fixing roller 124 is a columnar member, and includes an elastic layer made of silicone rubber or the like that is disposed on a core made of metal such as iron. The fixing roller 124 is connected with a motor which is not shown, and is rotated by the motor. Also, along with rotation of the fixing roller 124, the fixing belt 122, which is in contact with the outer circumferential surface of the fixing roller 124, rotates.

The heating roller 126 is a cylindrical member made of metal such as aluminum. Also, the halogen heater 132 is provided on the side of the inner circumference of the heating roller 126. When the halogen heater 132 is turned on, the heating roller 126 is heated. Then, heat of the heating roller 126 is transferred to the fixing belt 122, and as a result the fixing belt 122 is heated. Note that the surface of the heating roller 126 is coated with a release layer made of polytetrafluoroethylene (PTFE).

The pressure roller 128 is a columnar member. Specifically, the pressure roller 128 includes an elastic layer made of silicone rubber that is adhered to the outer circumferential surface of a cylindrical core made of metal such as STKM pipe. Further, a release layer made of PFA resin is provided on the surface of the elastic layer in order to prevent deposition of toner on the pressure roller 128. The pressure roller 128 is always in pressure-contact with the fixing roller 124 with the fixing belt 122 therebetween, except when JAM processing, printing on special sheets, and so on are performed. Accordingly, the pressure roller 128 forms a nip N with the fixing belt 122. Further, the pressure roller 128 rotates in conjunction with the fixing belt 122.

The temperature sensor 130 is for example a thermistor, and is disposed near part of the fixing belt 122 that is in contact with the outer circumferential surface of the heating roller 126. The temperature sensor 130 senses the surface temperature of the fixing belt 122, and outputs the surface temperature to the controller 40. Upon receiving the surface temperature of the fixing belt 122 from the temperature sensor 130, the controller 40 controls power supplied to the halogen heater 132 such that the surface temperature of the fixing belt 122 is maintained at a predetermined fixing temperature, that is, a target temperature for image heating. Note that a method of determining the target temperature is described later.

The fixer 100, which has the configuration as described above, fixes a toner image onto a sheet P passing through the nip N. Specifically, the sheet P, on which the toner image has been formed on the main surface thereof, is brought into contact with the fixing belt 122 at the nip N. As a result, the toner image is heated and fused. Further, the toner image is pressed against the sheet P by pressure applied from the fixing roller 124 and the pressure roller 128. In other words, the toner image is fixed onto the sheet P by heat and pressure.

(Nip Width Control Method, see FIG. 2 to FIG. 6)

The image forming apparatus 1 does not include an automatic pressure-contact and release mechanism that changes the pressure-contact status between the fixing belt 122 and the pressure roller 128 in accordance with the operation status of the fixer 100. Accordingly, it is necessary to control a nip width d (see FIG. 2), which is a width of the nip N in the conveyance direction of the sheets P, without use of the automatic pressure-contact and release mechanism. The following explains a control method of the nip width d in the image forming apparatus 1.

The nip width d varies due to thermal expansion of the pressure roller 128. Also, the pressure roller 128 receives heat transferred from the fixing belt 122, which forms the nip N with the pressure roller 128. An amount of heat transferred to the pressure roller 128 differs between a rotation period and a rest period of the fixing belt 122.

Figure 3:
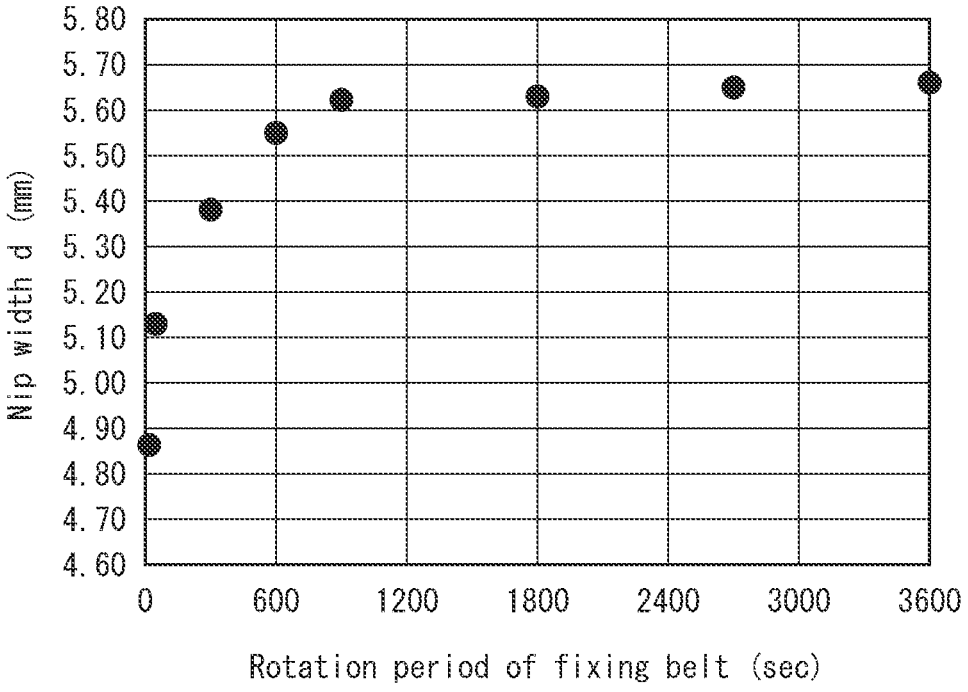
FIG. 3 is a graph showing a relation between a rotation period of a fixing belt and a nip width.
Figure 4:
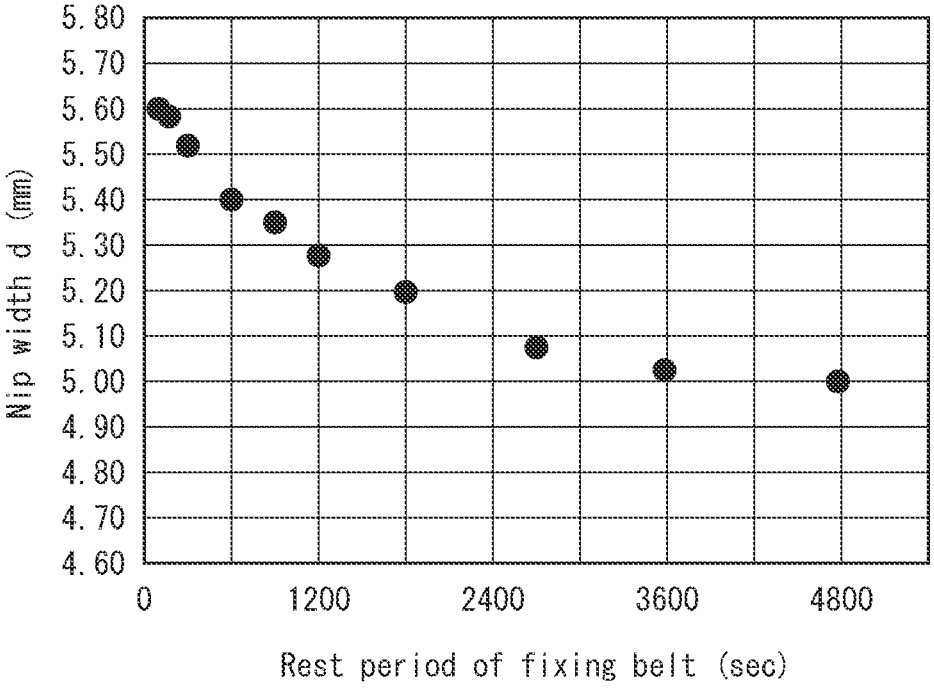
FIG. 4 is a graph showing a relation between a rest period of the fixing belt and the nip width.

Assume the case for example where the halogen heater 132 operates at the target temperature of 160 degrees C. in accordance with an instruction of the controller 40. In this case, when the fixing belt 122 rotates, the nip width d varies from approximate 4.85 mm to approximate 5.4 mm after 300 seconds, and to approximate 5.6 mm after 900 seconds, as shown in FIG. 3. Also, in the case where the fixing belt 122 in this state stops, the amount of heat transferred to the pressure roller 128 decreases. Accordingly, the nip width d varies from approximate 5.6 mm to approximate 5.2 mm after 1800 seconds, and to approximate 5.0 mm after 4800 seconds, as shown in FIG. 4. Referring to FIG. 4, the nip width d does not return to 4.8 mm, which is the original value of the nip width d. This is because heat of the halogen heater 132 is transferred to the pressure roller 128 via the fixing belt 122 even after the fixing belt 122 has stopped.

In this way, while the halogen heater 132 operates, the nip width d increases in accordance with the rotation period of the fixing belt 122, and decreases in accordance with the rest period of the fixing belt 122. That is, the nip width d correlates with the rotation period and the rest period of the fixing belt 122. According to the image forming apparatus 1, in view of this, the nip width d is calculated with use of the rotation period and the rest period of the fixing belt 122. In the case where the calculated nip width d is larger than a target nip width, the controller 40 decreases the target temperature of the fixing belt 122.

The following explains a calculation nip width process with a specific example. First, the controller 40 acquires information of a rotation period $t_{rot}$ indicating a last rotation period of the fixing belt 122. Assume that the rotation period $t_{rot}$ is five minutes, for example. Next, the controller 40 acquires information of a rest period $t_{stop}$ indicating for how many minutes the fixing belt 122 has rested after the last rotation. Assume that the rest period $t_{stop}$ is seven minutes. The controller 40 judges that, in calculating the nip width d, rest for seven minutes after rotation for five minutes of the fixing belt 122 is equivalent to rotation for 100 seconds without stop of the fixing belt 122. The temperature sensed by the internal temperature sensor 70 may be used for this judgment.

The controller 40 makes this judgment with reference to a rotation period conversion table that is stored in a storage region thereof. The rotation period conversion table records therein data indicating correspondence between a rest period of the fixing belt 122 after a predetermined rotation period and a rotation period in minutes without stop of the fixing belt 122, which correspond to the equal nip width.

The data recorded in the rotation period conversion table is obtained from the following Equation (1).

$$\delta_{rot}=t_{rot}-(t_{rot}-\delta\infty)\times t_{stop}/(t_{stop}+\beta_{rot}) \quad (1)$$

Figure 5:
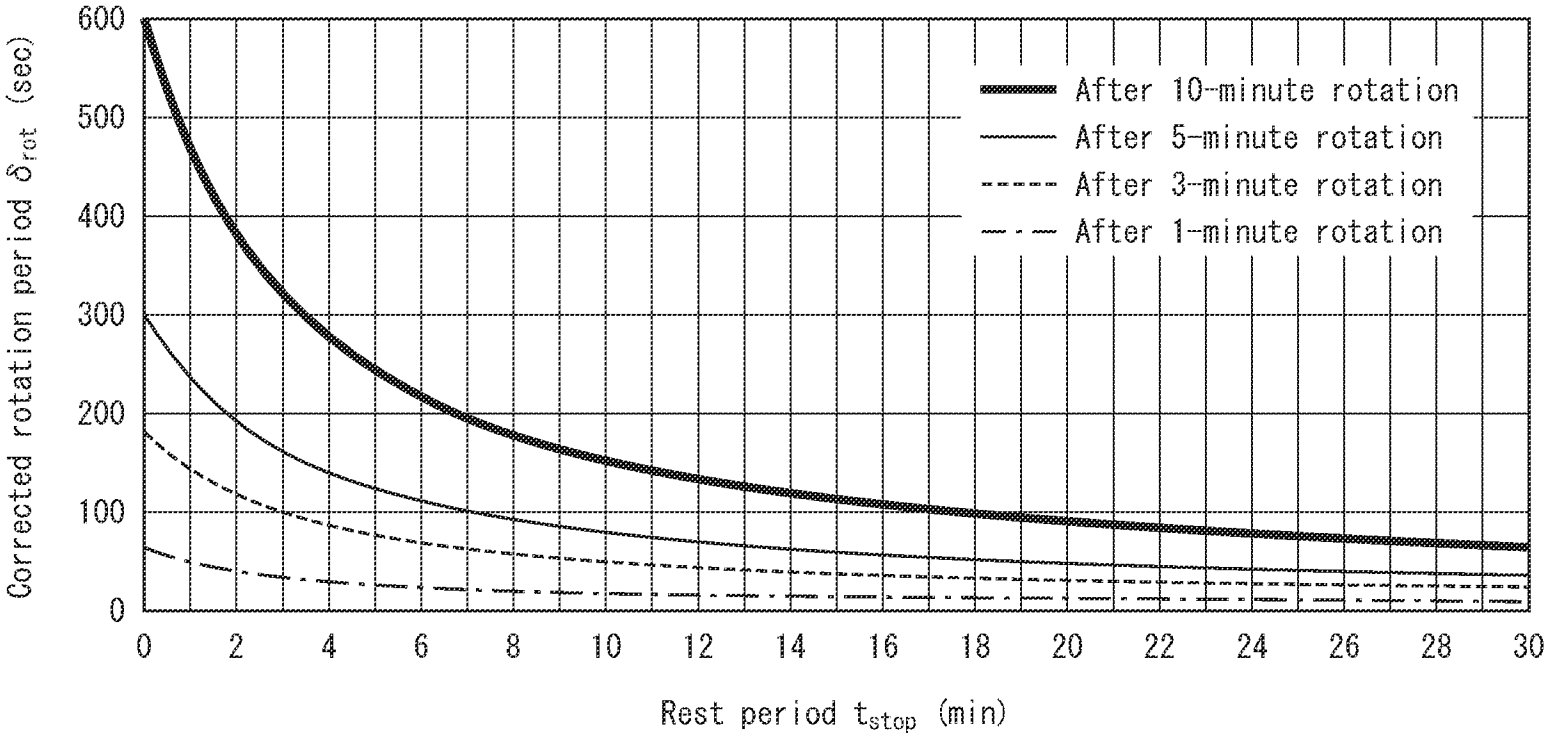
FIG. 5 is a graph showing a relation between the rest period after rotation of the fixing belt and a corrected rotation period of the fixing belt that is assumed to have rotated without stopping so as to form a nip width that is equal to a nip width corresponding to the rest period.

FIG. 5 shows curved lines expressing the Equation (1). Referring to FIG. 5, the abscissa represents the rest period $t_{stop}$ of the fixing belt 122 after rotation for a predetermined period, and the ordinate represents a rotation period of the fixing belt 122 that is assumed to have rotated without stopping so as to form a nip width that is equal to a nip width corresponding to the rest period $t_{stop}$. Hereinafter, this rotation period is referred to as corrected rotation period $\delta_{rot}$. Also, referring to FIG. 5, the bold curved line corresponds to rotation of the fixing belt 122 for 10 minutes, the solid line corresponds to rotation of the fixing belt 122 for five minutes, the dashed line corresponds to rotation of the fixing belt 122 for three minutes, and the dashed-dotted line corresponds to rotation of the fixing belt 122 for one minute. Here, the solid line in FIG. 5 corresponding to the rotation period $t_{rot}$ of five minutes is selected, and a numerical value of 100 is read off, which is on the ordinate corresponding to the rest period $t_{top}$ of seven minutes. The corrected rotation period $\delta_{rot}$ is obtained in this way.

As described above, the term $t_{rot}$ in the above Equation (1) indicates the rotation period of the fixing belt 122 corresponding to the nip width before stop, and expresses the initial value, that is, the intersection of each of the curved lines and the ordinate in FIG. 5. Also, the term $\delta\infty$ is related to the ambient temperature of the fixer 100, the outdoor temperature, and so on sensed by the internal temperature sensor 70, and expresses the convergence of each of the curved lines in FIG. 5. Further, the term $\beta_{rot}$ indicates a relation between the rest period of the fixing belt 122 and a decrease amount of the nip width d, and is related to the internal temperature. The higher the value of the term $\beta_{rot}$ is, the more quickly the nip width d decreases relative to the rest period. Moreover, the term $\beta_{rot}$ expresses the slope of each of the curved lines in FIG. 5. Note that when the internal temperature is high such as when the developing units 7 operate, the value of the term $\delta\infty$ is high. For example, when a ventilation fan provided in the image forming apparatus 1 operates or when a cover provided in the main body of the image forming apparatus 1 is open, the temperature of the fixer 100 quickly decreases, and thus the value of the term $\beta_{rot}$ is high is in such a situation. Conversely, when the internal temperature is high such as when the developing units 7 operate, the value of the term $\beta_{rot}$ is low.

Figure 6:
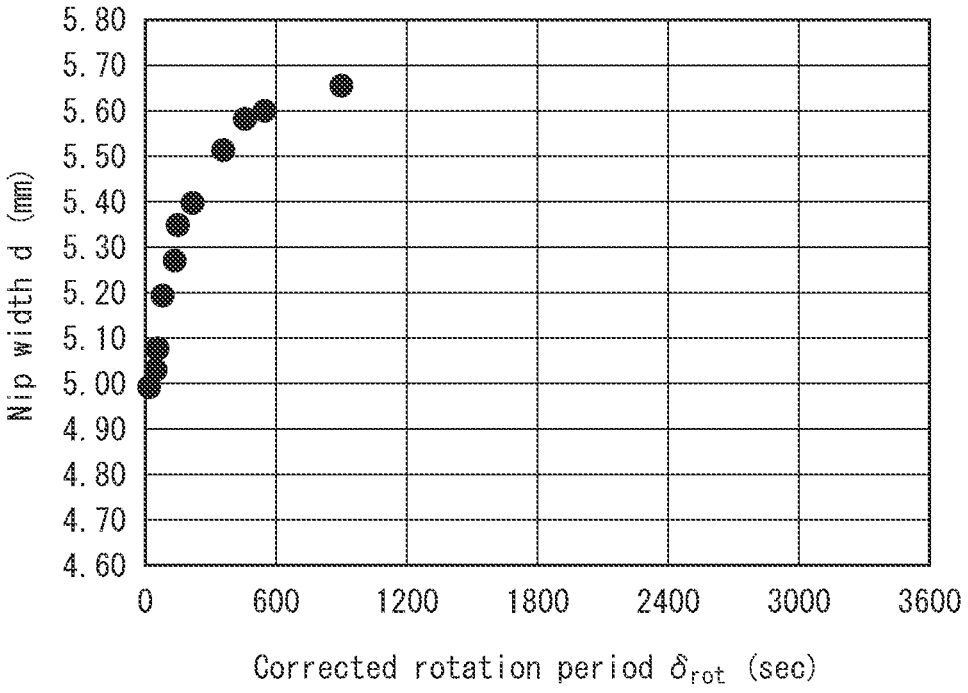
FIG. 6 is a graph showing a relation between the corrected rotation period of the fixing belt and the nip width.

When judging that the corrected rotation period $\delta_{rot}$ is 100 seconds, the controller 40 calculates a nip width corresponding to the corrected rotation period $\delta_{rot}$ of 100 seconds with reference to a nip width conversion table stored in the storage region thereof. The nip width conversion table records therein a relation between the corrected rotation period $\delta_{rot}$ and the nip width d. FIG. 6 shows part of the data recorded in the nip width conversion table. FIG. 6 demonstrates, for example, that the corrected rotation period $\delta_{rot}$ of 100 seconds corresponds to the nip width d of approximate 5.3 mm. In the case where the nip width d is larger than the target nip width, the controller 40 decreases the target temperature of the fixing belt 122. Specifically, as shown in FIG. 7, in the case where the nip width d is 5.3 mm or more to less than 5.5 mm, the controller 40 decreases the target temperature of the fixing belt 122 by five degrees C., and in the case where the nip width d is 5.5 mm or more, the controller 40 decreases the target temperature of the fixing belt 122 by 10 degrees C.

Also, the controller 40 regards the corrected rotation period $\delta_{rot}$, which has been lastly calculated, as the rotation period $t_{rot}$ of the fixing belt 122 to newly calculate the corrected rotation period $\delta_{rot}$, and newly calculates the nip width d from the newly calculated corrected rotation period $\delta_{rot}$.

By the way, the controller 40 calculates the nip width d at predetermined intervals such as intervals of 20 milliseconds, and backs up the corrected rotation period $\delta_{rot}$ obtained as a result of calculation of the nip width d to a non-volatile memory M. Note that the controller 40 does not necessarily perform backup to the non-volatile memory M for each calculation of the nip width d. Specifically, in the present embodiment, the values of the corrected rotation period $\delta_{rot}$ are divided into 18 sections as shown in FIG. 8. In the case where the section to which the value of the corrected rotation period $\delta_{rot}$ belongs has changed, the corrected rotation period $\delta_{rot}$ is backed up to the non-volatile memory M. Assume for example the case where the corrected rotation period $\delta_{rot}$ varies from 80 to 101 as a result of newly calculation of the nip width. In this case, the section to which the value of the corrected rotation period $\delta_{rot}$ belongs changes from Section 2 to Section 3. In such a case, the corrected rotation period $\delta_{rot}$ is backed up to the non-volatile memory M. In this way, in the case where the section to which the value of the corrected rotation period $\delta_{rot}$ belongs has changed, the corrected rotation period $\delta_{rot}$ is backed up to the non-volatile memory M. This reduces the frequency of backup compared with the case where backup is performed each time the nip width d is calculated, and thus delays the reach to the limit number of backup to the non-volatile memory M.

Further, in addition to the corrected rotation period $\delta_{rot}$, a recording time of the corrected rotation period $\delta_{rot}$ is also backed up to the non-volatile memory M. This is in order to, when the image forming apparatus is powered off and then is powered on again, calculate for how many minutes the fixing belt 122 has rested from the difference between the time backed up to the non-volatile memory M and the power-on time of the image forming apparatus 1. Then, the calculated rest period of the fixing belt 122 is used for the next calculation of the nip width d in the image forming apparatus 1. In the present embodiment, the recording time represented in year, month, day, and second is backed up to the non-volatile memory M.

Figure 9:
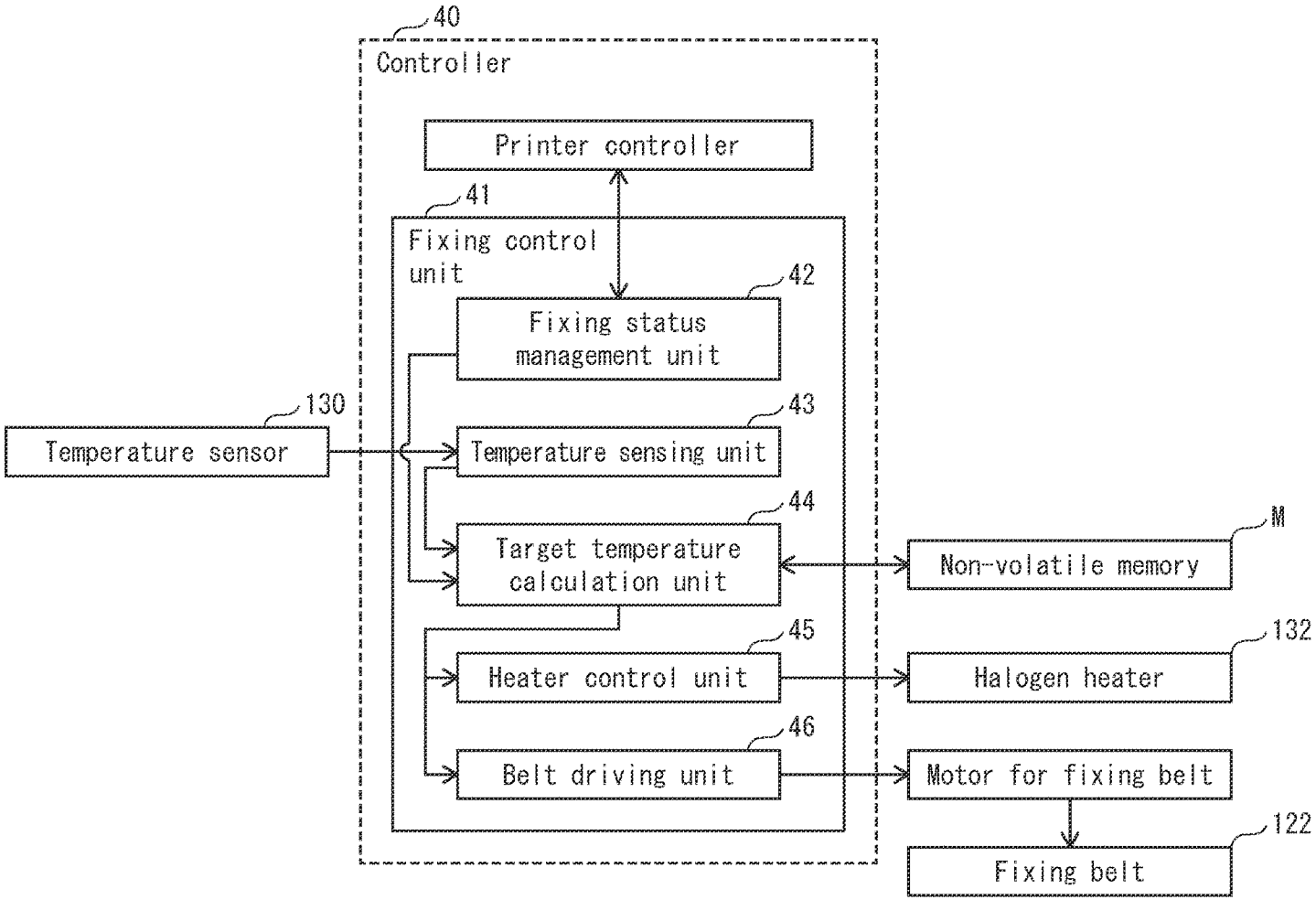
FIG. 9 is a block diagram showing parts relevant to nip width control.

(Parts Relevant to Control of Nip Width, see FIG. 9)

As shown in FIG. 9, control of the nip width d in the image forming apparatus 1 is performed by a fixing control unit 41 that is included in the controller 40 and manages control of the fixer 100. The fixing control unit 41 includes a fixing status management unit 42, a temperature sensing unit 43, a target temperature calculation unit 44, a heater control unit 45, and a belt driving unit 46.

The fixing status management unit 42 determines the status of the fixer 100 for warming-up, printing, and so on based on information acquired from a printer controller that is included in the controller 40 and is connected thereto. Then, the target temperature calculation unit 44 calculates the target temperature of the fixing belt 122 based on the determined status of the fixing belt 122 and information of the surface temperature of the fixing belt 122 sensed by the temperature sensor 130, which is received via the temperature sensing unit 43. The target temperature calculation unit 44 transmits the calculated target temperature to the heater control unit 45 and the belt driving unit 46. Then, the heater control unit 45 and the belt driving unit 46 control the halogen heater 132 and the fixing belt 122, respectively, in accordance with the target temperature calculated by the target temperature calculation unit 44. The following explains target temperature setting control of the fixing belt 122 relevant to control of the nip width upon power-on and upon print request, with reference to a flow chart in FIG. 10 and FIG. 11.

Figure 10:
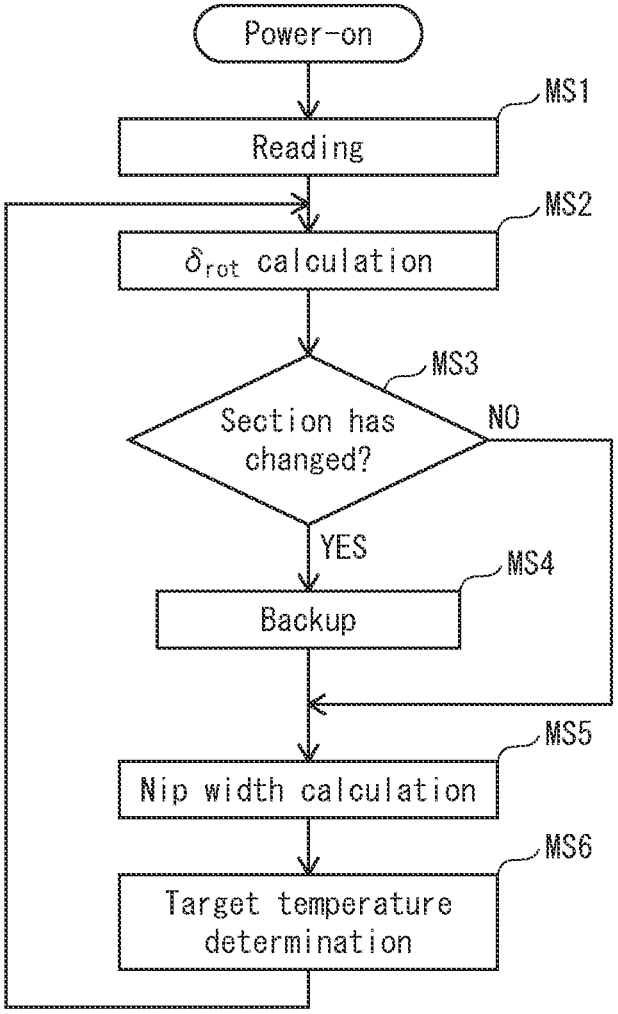
FIG. 10 is a flow chart showing target temperature setting control of the fixing belt upon power-on of the image forming apparatus.

(Target Temperature Setting Control Upon Power-On, see FIG. 10)

Upon power-on of the image forming apparatus 1, the target temperature of the fixing belt 122 is set and the temperature of the fixing belt 122 is controlled such that the image forming apparatus 1 is ready for printing, that is, in a standby state. This control is explained with reference to the flow chart in FIG. 10.

Upon power-on of the image forming apparatus 1, the control is started.

In Step MS1 in the control, the controller 40 reads a corrected rotation period $\delta_{rot}$ of the fixing belt 122 before power-off of the image forming apparatus 1, which is recorded in the non-volatile memory M, and a recording time of the corrected rotation period $\delta_{rot}$.

In Step MS2, the controller 40 newly calculates the corrected rotation period $\delta_{rot}$ with use of the information read in Step MS1. In the case where the previous recording time of the corrected rotation period $\delta_{rot}$ in the non-volatile memory M greatly differs from the power-on time of the image forming apparatus 1, the controller 40 newly calculates the corrected rotation period $\delta_{rot}$ not with use of the information recorded in the non-volatile memory M but with use of a rotation period and a rest period of the fixing belt 122 after power-on. This is because it is considered that in the case where the image forming apparatus 1 is in a power-off state for a long period, the fixer 100 has sufficiently cooled down.

Similarly, in the case where the temperature of the fixing belt 122 is lower than a threshold value temperature that is appropriately set, the controller 40 may newly calculate the corrected rotation period $\delta_{rot}$ not with use of the information recorded in the non-volatile memory M but with use of the rotation period and the rest period of the fixing belt 122 after power-on.

In Step MS3, the controller 40 judges whether or not the section to which the value of the corrected rotation period $\delta_{rot}$ belongs has changed. In the case where the section has changed, the control proceeds to Step MS4, and otherwise proceeds to Step MS5.

In Step MS4, the controller 40 backs up the corrected rotation period $\delta_{rot}$ and the recording time thereof to the non-volatile memory M.

In Step MS5, the controller 40 calculates the nip width d corresponding to the corrected rotation period $\delta_{rot}$ calculated in Step MS3 with reference to the nip width conversion table stored in the storage region thereof.

In Step MS6, the controller 40 determines the target temperature of the fixing belt 122 from the nip width d calculated in Step MS5. After determining the target temperature, the control returns to Step MS2. Then, the flow from Steps MS2 to MS6 in the control is repeated while the image forming apparatus 1 is in the standby state.

Figure 11:
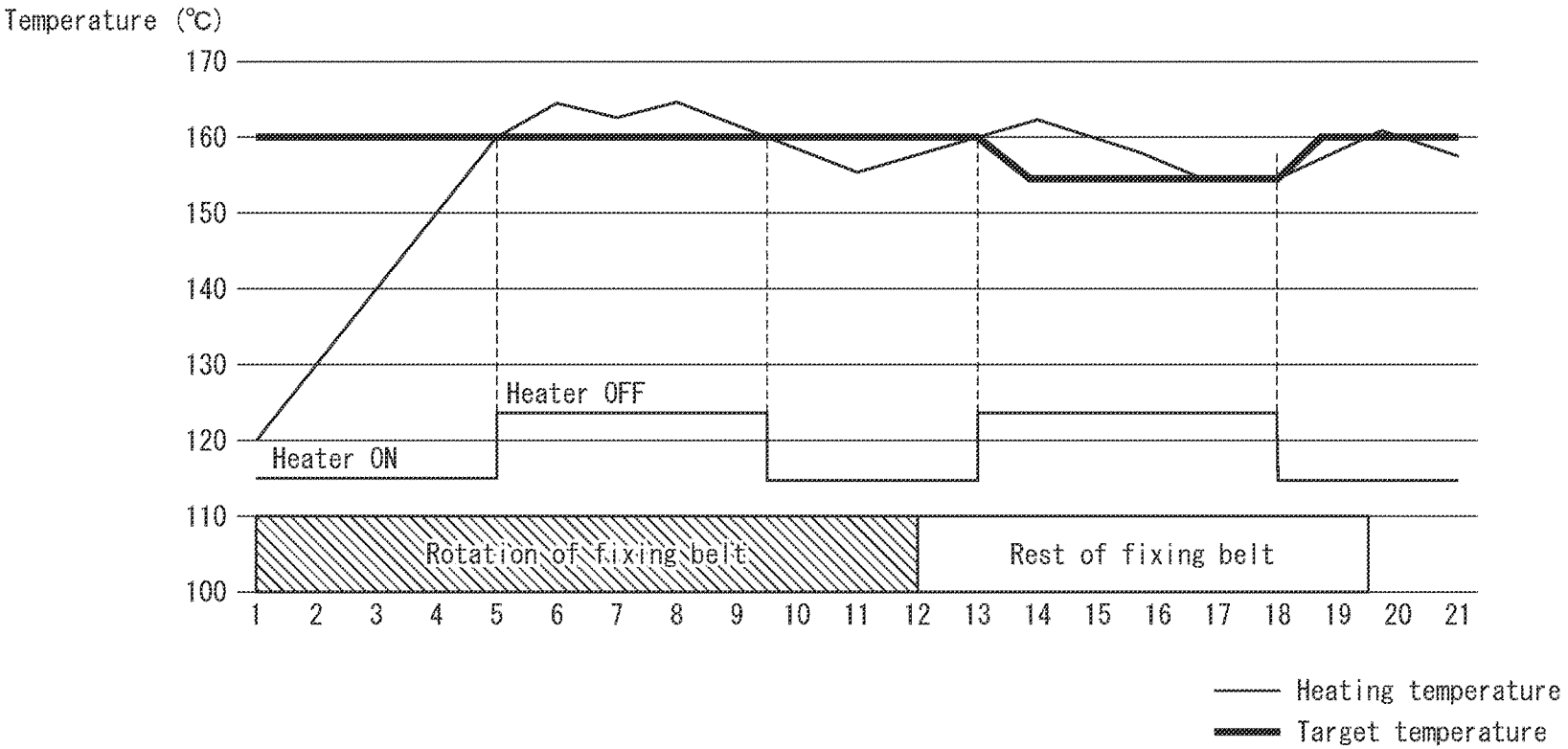
FIG. 11 is a graph exemplifying a relation between a period elapsed after power-on of the image forming apparatus and temperature variation of the fixing belt.

FIG. 11 shows the status of the fixing belt 122 which is temperature-controlled as described above. Referring to FIG. 11, the ordinate represents the temperature of the fixing belt 122, and the abscissa represents a period elapsed after power-on of the image forming apparatus 1. As shown in FIG. 11, substantially as soon as the image forming apparatus 1 is powered on, the halogen heater 132 is turned on and the fixing belt 122 is heated. Then, when the temperature of the fixing belt 122 exceeds the target temperature, the halogen heater 132 is turned off. When the temperature of the fixing belt 122 falls below the target temperature due to turn-off of the halogen heater 132, the halogen heater 132 is turned on again. The image forming apparatus 1 repeats this cycle while being in the standby state. Note that the fixing belt 122 also rotates for a predetermined period after power-on of the image forming apparatus 1 in order to equalize the surface temperature of the fixing belt 122.

Figure 12:
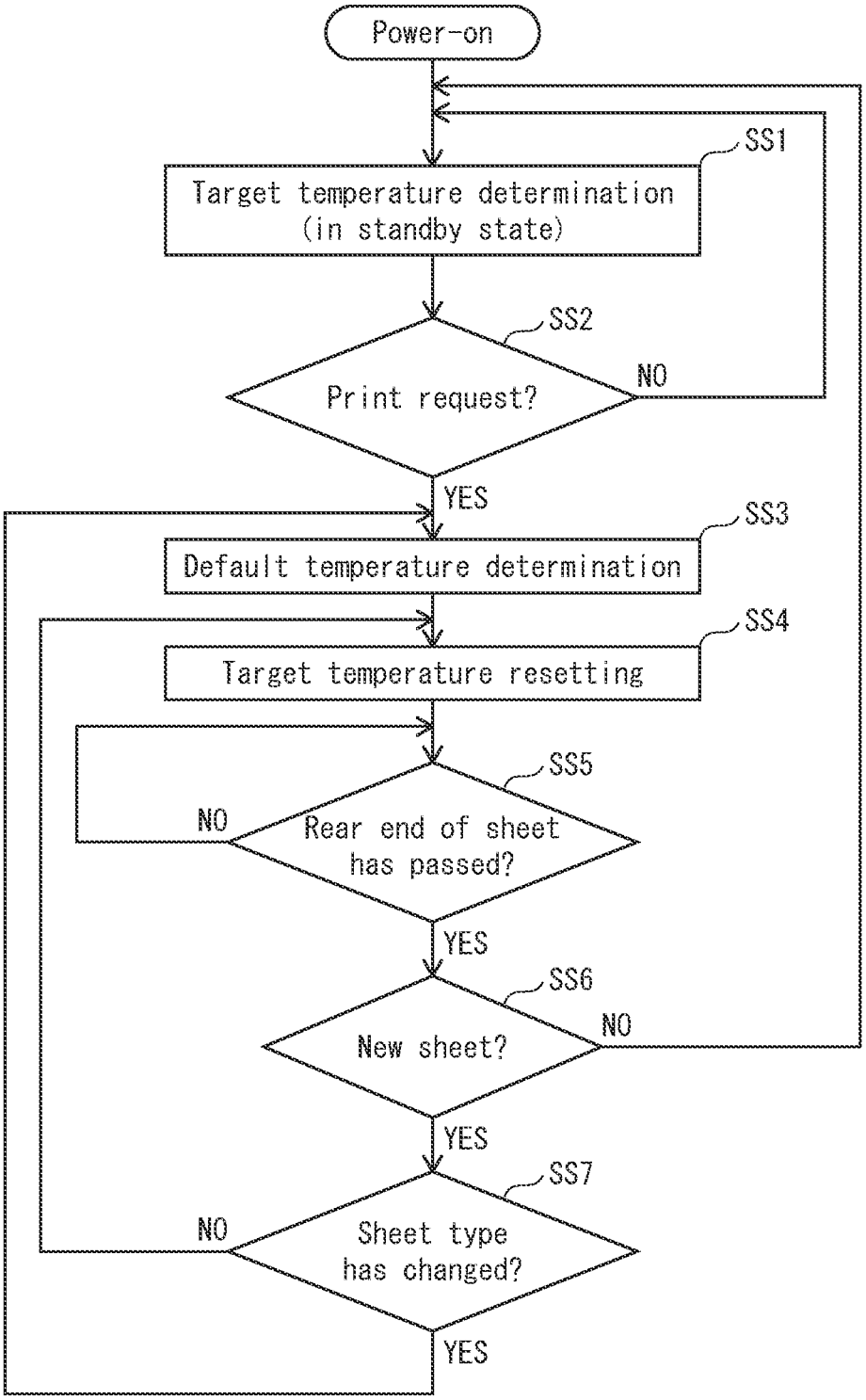
FIG. 12 is a flow chart showing target temperature resetting control of the fixing belt upon print request.

(Target Temperature Resetting Control Upon Print Request, see FIG. 12)

In the present embodiment, upon the print request, the target temperature of the fixing belt 122 is reset in accordance with the type of a printing sheet to be used. This is because how heat transfers differs depending on the type of printing sheets, and if the target temperature of the fixing belt 122 is uniformly determined irrespective of the type of sheets, the target nip width might not be obtained.

For example, as shown in FIG. 13, in the case where the internal temperature of the image forming apparatus 1 is the ordinary temperature and the type of a printing sheet is plain paper, the target temperature of the fixing belt 122 is set to 160 degrees C. as a standard target temperature (hereinafter, referred to as default temperature). Note that, as shown in FIG. 14, in the case where the nip width is 5.3 mm or more to 5.5 mm, the target temperature of the fixing belt 122 is decreased from the default temperature by five degrees C. In other words, the target temperature of the fixing belt 122 is set to 155 degrees C. On the other hand, in the case where the type of a printing sheet is heavy paper (heavy paper 1 in FIG. 13), the target temperature of the fixing belt 122 is set to 165 degrees C. as the default temperature for heavy paper at the ordinary temperature. Note that, as shown in FIG. 14, in the case where the nip width is 5.3 mm or more to 5.5 mm, the target temperature of the fixing belt 122 is decreased from the default temperature by two degrees C. In other words, the target temperature of the fixing belt 122 is set to 163 degrees C. The following explains the flow of the target temperature resetting control of the fixing belt 122 in accordance with the type of printing sheets, with reference to FIG. 12.

Upon power-on of the image forming apparatus 1, the control is started.

In Step SS1 in the control, the controller 40 sets the target temperature of the fixing belt 122 while the image forming apparatus 1 is in the standby state. This step is equivalent to Steps MS2 to MS6 in the above target temperature setting control upon power-on.

In Step SS2, the controller 40 judges whether or not a print request has been issued by the printer controller. In the case where the print request has been issued, the control proceeds to Step SS3, and otherwise returns to Step SS1.

In Step SS3, the controller 40 determines the default temperature of the fixing belt 122 for printing in accordance with the type of a printing sheet to be used.

In Step SS4, the controller 40 resets the target temperature of the fixing belt 122 for printing in consideration of the nip width. The target temperature is reset by decreasing the target temperature of the fixing belt 122 from the default temperature by a predetermined value, as described above.

In Step SS5, the controller 40 judges, based on a signal transmitted from the conveyance sensor 50, whether or not a target sheet is expected to complete passing through the fixer 100 soon, that is, whether or not the rear end of the target sheet has passed through a position that is short of the nip N (for example 20 mm short of the nip N) at the resetting time of the target temperature in Step SS4. In the case where the controller 40 judges that the rear end of the target sheet has passed through the position that is short of the nip N, the control proceeds to Step SS6. Otherwise, the control stands by in Step SS5.

In Step SS6, the controller 40 judges whether or not a new sheet is to be conveyed to the fixer 100 subsequent to the sheet which is currently passing through the fixer 100. In the case where the new sheet is to be conveyed to the fixer 100, the control proceeds to Step SS7, and otherwise returns to Step SS1.

In Step SS7, the controller 40 judges whether or not the type of the new sheet, which is to be conveyed to the fixer 100, is different from the type of the sheet, which is the currently passing through the fixer 100. In the case where the type of the new sheet is different, the control returns to Step SS3, and otherwise returns to Step SS4.

(Effects)

The image forming apparatus 1 does not include an air blower, an automatic pressure-contact and release mechanism, or the like for controlling the nip width d. Note that the nip width d correlates with the rotation period and the rest period of the fixing belt 122. In view of this, the image forming apparatus 1 executes the above image forming method to calculate the nip width d with use of the correlation with the rotation period and the rest period of the fixing belt 122, and thus controls the halogen heater 132 and so on in accordance with the calculated nip width d. According to the image forming apparatus 1, therefore, it is possible to control the nip width d to an appropriate value without including an air blower, an automatic pressure-contact and release mechanism, or the like.

Also, according to the image forming apparatus 1, Equation (1), which calculates the corrected rotation period $\delta_{rot}$ necessary for calculating the nip width d, includes the term $\delta\infty$ which is relevant to whether or not the developing units 7 operate and the term $\beta_{rot}$, which is relevant to the operation of the ventilation fan provided in the image forming apparatus 1 and opening and closing of the cover provided in the main body of the image forming apparatus 1. This allows further accurate calculation of the nip width d.

According to the image forming apparatus 1, by the way, the values of the corrected rotation period $\delta_{rot}$ are divided into 18 sections. In the case where the section to which the value of the corrected rotation period $\delta_{rot}$ belongs has changed, the corrected rotation period $\delta_{rot}$ is backed up to the non-volatile memory M. This structure reduces the frequency of backup compared with the case where backup is performed each time the nip width d is calculated, and thus delays the reach to the limit number of backup to the non-volatile memory M.

Further, in addition to the corrected rotation period $\delta_{rot}$, the recording time of the corrected rotation period $\delta_{rot}$ is also backed up to the non-volatile memory M. This structure allows, when the image forming apparatus is powered off and then is powered on again, calculation of for how many minutes the fixing belt 122 has rested from the difference between the time backed up to the non-volatile memory M and the power-on time of the image forming apparatus 1. According to the image forming apparatus 1, therefore, it is possible to acquire the rest period of the fixing belt 122 while the image forming apparatus 1 is powered off, and use the rest period for the next calculation of the nip width d.

(Modifications)

The image forming apparatus relating to the present invention is not limited by the above embodiment, and may be variously modified without departing from the scope of the present invention. For example, the number of sections used for determining the backup timing to the non-volatile memory M and the value range of the corrected rotation period $\delta_{rot}$ in each section may be arbitrary values. Further, in the case where the fixer 100 is replaced for example, the fixing belt 122 and so on return to the default state, and accordingly the corrected rotation period $\delta_{rot}$ and so on, which have been calculated, may be cleared.

(Summary)

As described above, one aspect of the present invention provides an image formation apparatus comprising: a fixer that fixes a toner image onto a sheet by heat and pressure, and includes: a heat source; a first rotary member that is heated by the heat source; a temperature sensing unit that senses a temperature of the first rotary member; and a second rotary member that forms a nip with the first rotary member for applying heat and pressure to the sheet; and a controller that calculates a nip width of the nip in a passing direction of the sheet with use of a rotation period and a rest period of the first rotary member during which the heat source operates, and changes a target temperature of the first rotary member in accordance with the calculated nip width. With this structure, it is possible to appropriately control the nip width without using a temperature adjuster, an automatic pressure-contact and release mechanism, or the like.

Also, the controller may include a non-volatile storage unit that stores therein a corrected rotation period, and the controller may calculate a new corrected rotation period with use of the corrected rotation period read from the storage unit and the rest period at predetermined intervals, stores the new corrected rotation period in the storage unit, and calculates the nip width with use of the new corrected rotation period.

Also, when the temperature sensed by the temperature sensing unit is lower than a predetermined temperature, the controller may calculate the nip width without use of the corrected rotation period read from the storage unit.

Also, the controller may include a non-volatile storage unit that stores therein a corrected rotation period and a time, and the controller may calculate a new corrected rotation period with use of the corrected rotation period read from the storage unit and the rest period at predetermined intervals, store the new corrected rotation period and a current time in the storage unit, and calculate the nip width with use of the new corrected rotation period, and upon power-on, the controller may calculate the nip width with use of the new corrected rotation period and a difference between the time read from the storage unit and a time of the power-on.

Also, the controller may change the target temperature such that as the calculated nip width increases, the target temperature decreases.

Also, the controller may change the target temperature further in accordance with type of the sheet passing through the nip.

Also, upon replacement of the fixer, the controller may clear the corrected rotation period stored in the storage unit.

Also, upon replacement of the fixer, the controller may clear the corrected rotation period stored in the storage unit.

Also, the image formation apparatus may further comprise a developing unit, wherein the controller may change the target temperature further in accordance with a driving status of the developing unit.

Also, the controller may change the target temperature further in accordance with an ambient temperature of the fixer.

Another aspect of the present invention provides an image formation method executed by an image formation apparatus including a fixer, the fixer fixing a toner image onto a sheet by heat and pressure and including: a heat source; a first rotary member that is heated by the heat source; a temperature sensing unit that senses a temperature of the first rotary member; and a second rotary member that forms a nip with the first rotary member for applying heat and pressure to the sheet, the image formation method comprising the steps of: acquiring a rotation period and a rest period of the first rotary member during which the heat source operates; calculating a nip width of the nip in a passing direction of the sheet with use of the rotation period and the rest period; and changing a target temperature of the first rotary member in accordance with the calculated nip width.

Also, the image forming apparatus may further include a non-volatile storage unit that stores therein a corrected rotation period, and the calculating may calculate a new corrected rotation period with use of the corrected rotation period read from the storage unit and the rest period at predetermined intervals, store the new corrected rotation period in the storage unit, and calculate the nip width with use of the new corrected rotation period.

Also, when the temperature sensed by the temperature sensing unit is lower than a predetermined temperature, the calculating may calculate the nip width without use of the new corrected rotation period.

Also, the image forming apparatus may further include a non-volatile storage unit that stores therein a corrected rotation period and a time, and the calculating may calculate a new corrected rotation period with use of the corrected rotation period read from the storage unit and the rest period at predetermined intervals, store the new corrected rotation period and a current time in the storage unit, and calculate the nip width with use of the new corrected rotation period, and upon power-on, the calculating may calculate the nip width with use of the new corrected rotation period and a difference between the time read from the storage unit and a time of the power-on.

Also, the changing may change the target temperature such that as the calculated nip width increases, the target temperature decreases.

Also, the changing may change the target temperature further in accordance with type of the sheet passing through the nip.

Also, upon replacement of the fixer, the calculating may clear the corrected rotation period stored in the storage unit.

Also, the image forming apparatus may further include a developing unit, the changing may change the target temperature further in accordance with a driving status of the developing unit.

Also, the changing may change the target temperature further in accordance with an ambient temperature of the fixer.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An image formation apparatus comprising:

a fixer that fixes a toner image onto a sheet by heat and pressure, and includes:

a heat source;

a first rotary member that is heated by the heat source;

a temperature sensing unit that senses a temperature of the first rotary member; and a second rotary member that forms a nip with the first rotary member for applying heat and pressure to the sheet; and a controller that calculates a nip width of the nip in a passing direction of the sheet with use of a rotation period and a rest period of the first rotary member during which the heat source operates, and changes a target temperature of the first rotary member in accordance with the calculated nip width.

2. The image formation apparatus of claim 1, wherein the controller includes a non-volatile storage unit that stores therein a corrected rotation period, and the controller calculates a new corrected rotation period with use of the corrected rotation period read from the storage unit and the rest period at predetermined intervals, stores the new corrected rotation period in the storage unit, and calculates the nip width with use of the new corrected rotation period.

3. The image formation apparatus of claim 2, wherein when the temperature sensed by the temperature sensing unit is lower than a predetermined temperature, the controller calculates the nip width without use of the corrected rotation period read from the storage unit.

4. The image formation apparatus of claim 1, wherein the controller includes a non-volatile storage unit that stores therein a corrected rotation period and a time, and the controller calculates a new corrected rotation period with use of the corrected rotation period read from the storage unit and the rest period at predetermined intervals, stores the new corrected rotation period and a current time in the storage unit, and calculates the nip width with use of the new corrected rotation period, and upon power-on, the controller calculates the nip width with use of the new corrected rotation period and a difference between the time read from the storage unit and a time of the power-on.

5. The image formation apparatus of claim 1, wherein the controller changes the target temperature such that as the calculated nip width increases, the target temperature decreases.

6. The image formation apparatus of claim 1, wherein the controller changes the target temperature further in accordance with type of the sheet passing through the nip.

7. The image formation apparatus of claim 2, wherein upon replacement of the fixer, the controller clears the corrected rotation period stored in the storage unit.

8. The image formation apparatus of claim 4, wherein upon replacement of the fixer, the controller clears the corrected rotation period stored in the storage unit.

9. The image formation apparatus of claim 1, further comprising a developing unit, wherein the controller changes the target temperature further in accordance with a driving status of the developing unit.

10. The image formation apparatus of claim 1, wherein the controller changes the target temperature further in accordance with an ambient temperature of the fixer.

11. An image formation method executed by an image formation apparatus including a fixer, the fixer fixing a toner image onto a sheet by heat and pressure and including: a heat source; a first rotary member that is heated by the heat source; a temperature sensing unit that senses a temperature of the first rotary member; and a second rotary member that forms a nip with the first rotary member for applying heat and pressure to the sheet, the image formation method comprising the steps of:

acquiring a rotation period and a rest period of the first rotary member during which the heat source operates;

calculating a nip width of the nip in a passing direction of the sheet with use of the rotation period and the rest period; and changing a target temperature of the first rotary member in accordance with the calculated nip width.

12. The image formation method of claim 11, wherein the image forming apparatus further includes a non-volatile storage unit that stores therein a corrected rotation period, and the calculating calculates a new corrected rotation period with use of the corrected rotation period read from the storage unit and the rest period at predetermined intervals, stores the new corrected rotation period in the storage unit, and calculates the nip width with use of the new corrected rotation period.

13. The image formation method of claim 12, wherein when the temperature sensed by the temperature sensing unit is lower than a predetermined temperature, the calculating calculates the nip width without use of the new corrected rotation period.

14. The image formation method of claim 11, wherein the image forming apparatus further includes a non-volatile storage unit that stores therein a corrected rotation period and a time, and the calculating calculates a new corrected rotation period with use of the corrected rotation period read from the storage unit and the rest period at predetermined intervals, stores the new corrected rotation period and a current time in the storage unit, and calculates the nip width with use of the new corrected rotation period, and upon power-on, the calculating calculates the nip width with use of the new corrected rotation period and a difference between the time read from the storage unit and a time of the power-on.

15. The image formation method of claim 11, wherein the changing changes the target temperature such that as the calculated nip width increases, the target temperature decreases.

16. The image formation method of claim 11, wherein the changing changes the target temperature further in accordance with type of the sheet passing through the nip.

17. The image formation method of claim 12, wherein upon replacement of the fixer, the calculating clears the corrected rotation period stored in the storage unit.

18. The image formation method of claim 14, wherein upon replacement of the fixer, the calculating clears the corrected rotation period stored in the storage unit.

19. The image formation method of claim 11, wherein the image forming apparatus further includes a developing unit, wherein the changing changes the target temperature further in accordance with a driving status of the developing unit.

20. The image formation method of claim 11, wherein the changing changes the target temperature further in accordance with an ambient temperature of the fixer.

* * * * *